United States Patent [19]

Nishijima

[11] Patent Number: 5,039,597

[45] Date of Patent: Aug. 13, 1991

[54] DYE IMAGE FORMING METHOD

[75] Inventor: Toyoki Nishijima, Odawara, Japan

[73] Assignee: Konica Corporation, Tokyo, Japan

[21] Appl. No.: 567,696

[22] Filed: Aug. 13, 1990

Related U.S. Application Data

[63] Continuation of Ser. No. 302,393, Jan. 26, 1989, abandoned.

[30] Foreign Application Priority Data

Jan. 30, 1988 [JP] Japan ..... 63-20358

[51] Int. Cl.[5] ..... G03C 1/46; G03C 7/46

[52] U.S. Cl. ..... 430/383; 430/386; 430/393; 430/505

[58] Field of Search ..... 430/383, 386, 393, 505, 430/554, 555

[56] References Cited

U.S. PATENT DOCUMENTS 4,774,168 9/1988 Ogawa et al. ..... 430/383
4,788,133 11/1988 Sauerteig et al. ..... 430/505
4,822,726 4/1989 Ikeda et al. ..... 430/550
4,828,970 5/1989 Kuse et al. ..... 430/393

FOREIGN PATENT DOCUMENTS 234292 9/1987 European Pat. Off. .
234460 9/1987 European Pat. Off. .
243096 10/1987 European Pat. Off. .

*Primary Examiner*—Charles L. Bowers, Jr.
*Assistant Examiner*—Janet C. Baxter
*Attorney, Agent, or Firm*—Jordan B. Bierman

[57] ABSTRACT

A method of forming a dye image suitable for a rapid process is disclosed. The method comprises the steps of, (i) imagewise exposing a light-sensitive silver halide photographic material comprising a support and provided thereon a blue-sensitive silver halide emulsion layer, a green-sensitive silver halide emulsion layer and a red-sensitive silver halide emulsion layer, wherein said green-sensitive silver halide emulsion layer contains silver halide grains of which silver chloride content is not less than 90 mol %, and a magenta dye-forming coupler having a pKa value of not more than 8.80; and wherein the total amount of silver halide contained in said blue-sensitive, green-sensitive and red-sensitive layers being not more than 7.8 mg/dm$^2$ in terms of silver;

(ii) color developing said photographic material; and immediately after the color development, (iii) processing said photographic material with a solution having a bleaching capability and having a pH value of from 4.5 to 6.5

9 Claims, No Drawings

DYE IMAGE FORMING METHOD

This application is a continuation of application Ser. No. 07/302,393, filed Jan. 26, 1989, now abandoned.

FIELD OF THE INVENTION

The invention relates to a dye image forming method, in particular, to a dye image forming method suitable for rapid processing and capable of providing an image with considerably low minimum density.

BACKGROUND OF THE INVENTION

Recently, in the photographic art, light-sensitive silver halide photographic materials which are adaptable to rapid processing, which are capable of providing a high quality image and superior processing stability, and which can be manufactured at a lower cost have been in need. The particular need is for the material capable of ultra-rapid processing.

Usually, a light-sensitive silver halide photographic material is subjected to continuous treatment with an automatic developing machine installed in a development laboratory. To improve user-oriented service, same-day processing is required; the light-sensitive material is developed and returned to a user within the same day the material had been submitted to the laboratory. More recently, an even shorter processing service is required; the light-sensitive material is returned to a user within a few hours from the reception of the material. Thus, there are increasing needs for more rapid processing. At the same time, decreasing the processing time means improved processing productivity, and, possibly, lower costs. Therefore, rapid processing is an inevitable necessity.

Studies for achieving rapid processing have been centered on two aspects; the light-sensitive material and the processing solutions. In color developing, studies for achieving rapid processing have been based on higher temperature, higher pH level, higher concentration of color developing agents, and, further, additional additives such as development accelerators. Examples of such a development accelerator include 1-phenyl-3-pyrazolidones described in British Patent No. 811,185, N-methyl-p-aminophenols described in British Patent No. 2,417,514, and N,N,N',N'-tetramethyl-p-phenylenediamines described in Japanese Patent Publication Open to Public Inspection (hereinafter referred to as Japanese Patent O.P.I. Publication) No. 15554/1975. However, these methods often fail to achieve sufficiently rapid processing and even incur deterioration such as increased fog.

Meanwhile, it is known that the configuration, size, and composition of silver halide grains in a silver halide emulsion greatly affect the developing speed and the like. It is also known that the halogen composition particularly affects the developing speed, and that an emulsion with high silver chloride content provides a remarkably high developing speed.

However, maintaining the rapid developability of a high chloride silver halide emulsion usually incurs increased fog.

Especially in the color developing system, because colored dye is formed, the fog density is more conspicuous than in that of a black and white developing system; this poses a serious problem in positively ensuring the rapid processability of high chloride silver halide emulsions.

Generally, antifogging agents are used to decrease the fog density. One of the most commonly known antifogging agents is potassium bromide which has been used in various developers. However, when a sample having high chloride silver halide emulsion is processed in a color developer system containing potassium bromide, its rapid processability is remarkably jeopardized. This means that potassium bromide acts as an extremely strong developing inhibitor o the high chloride silver halide emulsion rather than acting as an antifogging agent. Therefore, it is essential for rapid processing that potassium bromide is not virtually contained in the color developer system in which the high chloride silver halide emulsion is processed. Further, the fogging problem remains more difficult to solve.

Meanwhile, various other organic inhibitors are known as antifogging agents. For example, such agents are described in "Stabilization of Photographic Silver Halide Emulsions" by E.J. Birr, Focal Press (1974). Among these antifogging agents, many heterocyclic mercapto compounds have a strong antifogging effect and have been commonly used.

In general, light-sensitive silver halide photographic materials are uninterruptedly treated in various processing laboratories, with replenishers being continuously fed. It is impossible, in such an operation, to keep the compositions of processing solutions constant from the beginning through to the end of the running treatment. The resultant composition change of the processing solution causes a fluctuation in photographic properties. This problem is becoming more serious owing to the recent trend toward lower replenishing rates for processing solutions.

In regard to the composition change above, it is virtually impossible to completely avoid the developer becoming contaminated with the bleach-fixer, even by taking measures such as strictly predetermined replenishing rates for replenishers, evaporation prevention, and elimination of substances possibly eluted from the light-sensitive material. Therefore, especially in the case of a roller-conveyance type automatic developing machine, the degree to which the developer becomes contaminated with the bleach-fixer tends to fluctuate greatly depending on the amount of material being treated, and the squeezing manner. A lower replenishing rate of the processing solution causes greater contamination because the recycling rate of the processing solution decreases.

Furthermore, since the pH of the color developer is maintained at a high level, pH fluctuation of the color developer is unavoidable owing to the accumulated amount of the replenisher or air oxidation during the running treatment.

Such fluctuation in the color developer tends to induce fogging. Said antifogging agents can inhibit fogging to some extent if the agents are properly used.

However, an increase in minimum density (in magenta dye image, in particular) is induced during transition from the color developing process to the bleaching process in an automatic developing machine. Although this phenomenon can be prevented by using a considerable amount of said agents, a new problem occurs: developability and desilvering properties of the light-sensitive material deteriorate.

SUMMARY OF THE INVENTION

The invention has been intended to solve the above-mentioned disadvantages of the prior art, and, therefore, the object of the invention is to provide a dye image forming method that, without deteriorating developability and desilvering properties of the sensitive material, prevents magenta stain by means of rapid processing.

The above-mentioned object of the invention is achieved by a method of forming a dye image comprising the steps of, (i) imagewise exposing a light-sensitive silver halide photographic material comprising a support and provided thereon a blue-sensitive silver halide emulsion layer, a green-sensitive silver halide emulsion layer and a red-sensitive silver halide emulsion layer, wherein said green-sensitive silver halide emulsion layer contains silver halide grains of which silver chloride content is not less than 90 mol%, and a magenta dye-forming coupler of which pKa value is not more than 8.80; and wherein the total amount of silver halide contained in said blue-sensitive, green-sensitive and red-sensitive layers being not more than 7.8 mg/dm$^2$ in terms of silver; (ii) color developing said photographic material, and immediately after the color development, (iii) processing said photographic material with a solution having a bleaching capability and pH value of from 4.5 to 6.5.

DETAILED DESCRIPTION OF THE INVENTION

Preferred silver halide grains used in the invention have not less than 90 mol% of silver chloride, not less than 10 mol% of silver bromide. More specifically, the silver halide grains are silver chlorobromide having 0.1 to 2 mol% of silver bromide.

The silver halide grains of the invention may be used singly, or used after being mixed with other silver halide grains having a different composition, or used after being mixed with silver halide grains having not more than 10 mol% of silver chloride.

In the silver halide emulsion layer containing the silver halide grains having not less than 90 mol% silver chloride content of the invention, the proportion of silver halide grains having not less than 90 mol% of silver chloride content to the total silver halide grains is not less than 60 wt%, or, preferably, not less than 80 wt%.

The composition of silver halide grains of the invention may be homogeneous from the interior to the surface of the grains, or may be different between the interior and the surface. In the case of different composition between the interior and the surface, the composition may change continuously or discontinuously.

There is no specific limitation on the grain size of silver halide grains of the invention. However, in view of rapid-processability, sensitivity, and other photographic performance criteria, the preferred grain size is 0.2 to 1.6 μm, in particular, 0.25 to 1.2 μm. The grain size can be achieved by various methods known in the photographic art. Typical methods are described in "Analysis Method of Grain Size" (by Labrand), A.S.T.M. Symposium on Light Microscopy (1955), pp. 94–122; "The Theory of the Photographic Process:" by Mees and James, 3rd edition, Chapter 2, Published from Macmillan Company (1966).

The grain sizes can be measured based on projected areas or approximate diameter values of grains. When silver halide grains have virtually identical configurations, the grain size distribution can be expressed with considerable precision by diameter or projected area.

The grain size distribution of the silver halide grains used in the present invention may be either a multi-dispersed or monodispersed type. However, the monodispersed silver halide grains preferably have the variation coefficient of not more than 0.22, or, more preferably, not more than 0.15, in terms of the size distribution of the silver halide grains contained in an emulsion. The variation coefficient is a coefficient indicating the range of the grain size distribution and is defined by the following expressions.

Variation coefficient $(S/r) =$ $$\frac{\text{Standard deviation of size distribution}}{\text{Average grain size}}$$

Standard deviation of grains size distribution $(S) =$ $$\sqrt{\frac{\Sigma (r - ri)^2 ni}{\Sigma ni}}$$

$$\text{Average grain size } (r) = \frac{\Sigma niri}{\Sigma ni}$$

In the above expressions, ri represents sizes of independent grains; ni, a number of independent grains counted. The term "grain size" here means a diameter of an independent spherical silver halide grain; a diameter, when the grain is cubic or has any shape other than a spherical shape, of a projected image converted into a circular image.

The silver halide grains used in the emulsion of the invention are prepared by any of the acid process, neutral process, and ammonium process. The grains may be grown at once, or may be grown after forming seed grains. A method for forming seed grains may be identical with or different from a method for growing the grains.

As a method for reacting soluble silver salt with soluble halide salt, the normal precipitation method, reverse precipitation method or double-jet precipitation method, or a combination of these methods is arbitrarily used. Among these methods, the double-jet precipitation method is advantageous. Furthermore, a pAg-controlled double-jet method disclosed in Japanese Patent O.P.I. Publication No. 48521/1979, a modification of the double-jet precipitation method, may also be used.

If necessary, a solvent for silver halide such as thioether may be used. A mercapto-group containing compound, nitrogen containing heterocyclic compound, or sensitizing dye or the like may be also added during the formation of silver halide grains or after the formation of the grains.

The configurations of silver halide grains according to the invention are arbitrarily selected. The preferred example is a cubic grain having {100} face as a crystal face. Additionally, octahedral, tetradecahedral or dodecahedral grains may be prepared using the methods described in U.S. Pat. Nos. 4,183,756, and 4,225,666, Japanese Patent O.P.I. Publication No. 26589/1980, Japanese Patent Examined Publication No. 42737/1980, and in the Journal of Photographic Science 21, 39 (1973), and the like, thereby the resultant silver halide grains may be used in embodying the invention. Also, grains having twin planes may be used. The silver halide grains may comprise grains of a common configuration, or may be a mixture of various configurations.

In silver halide grains used in the emulsion of the invention, during the grain forming process and/or grain growing process, any metal ion selected from cadmium salt, zinc salt, lead salt, thallium salt, iridium salt or complex salt thereof, rhodium slat or complex salt thereof, iron salt or complex salt thereof can be added and contained in the interior and/or the surface of the grains, and, under a suitable reducing atmosphere, the sensitizing cores can be endowed in the interior and/or the surface of the grains.

Excess soluble salts in the emulsion containing silver halide grains of the invention (hereinafter referred to as the emulsion of the invention) may be either removed or left unremoved after the termination of silver halide grain-growing. Such salt can be removed in compliance with the methods described in Research Disclosure No. 17643.

The silver halide grains of the invention may be those where latent images are primarily formed either on the surface thereof or in the interior thereof. The preferred grains are those where latent images re primarily formed on the surface thereof.

The emulsion of the invention is chemically sensitized using the conventional methods such as sulfur sensitizing methods using compounds containing sulfur reactive with silver ion, or containing activated gelatin; selenium sensitizing methods using selenium compounds; reducing sensitizing methods using reducing substances; noble metal sensitizing methods using gold or other noble metal compounds, wherein these methods can be used singly or in combination.

According to the invention, chemical sensitizers such as a chalcogen sensitizer can be used. The chalcogen sensitizer is a general term covering sulfur sensitizer, selenium sensitizer, and tellurium sensitizer. Sulfur or selenium sensitizer is advantageous for photographic application. The useful sulfur sensitizers include thiosulfate, allylthiocarbazide, thiourea, allylisothiocyanate, cystine, p-toluene thiosulfonate, and rhodanine. Other useful sulfur sensitizers are described, for example, in U.S. Pat. Nos. 1,574,994, 2,410,689, 2,278,947, 2,728,668, 3,501,313, 3,656,955, West Germany OLS 1,422,869, and Japanese Patent O.P.I. Publication Nos. 24937/1971 and 45016/1980. The amount of sulfur sensitizer being added is $10^{-7}$ to $10^{-1}$ mol per mol silver halide, although the amount greatly varies depending on various conditions such as pH, temperature and silver halide grain size.

Selenium sensitizers may be used instead of sulfur sensitizers. The examples of useful selenium sensitizers include aliphatic isoselenocyanates such as allylisocyanate; selenoureas; selenoketones; selenoamides; selenocarboxylic salts and esters; selenophosphates; and selenides such as diethyl selenide and diethyl diselenide. The typical examples of these selenium sensitizers are described in U.S. Pat. Nos. 1,574,944, 1,602,592, and 1,623,499.

Further, reduction sensitizers can be used in conjunction with the above chalcogen sensitizers. The useful reducing agents, although not specifically limited, include stannous chloride, thiourea dioxide, hydrazine, and polyamine.

Noble metal compounds other than gold compounds, such as palladium compounds are also used in conjunction.

The silver halide grains of the invention preferably contain a gold compound. The oxidation number of the gold of such gold compounds can be either +1 or +3. The useful gold compounds include chloroaurate, potassium chloroaurate, auric trichloride, potassium auric thiocyanate, potassium iodoaurate, tetracyanoauric azide, ammonium aurothiocyanate, pyridyl trichloro gold, gold sulfide, and gold selenide. These gold compounds can be used either to sensitize or virtually not to sensitize the silver halide grains.

The amount of gold sensitizer added varies depending on various conditions. As a guideline, the amount is $10^{-8}$ to $10^{-1}$ mol, or preferably, $10^{-7}$ to $10^{-2}$ mol per mol silver halide. The timing of adding these compounds can be arbitrarily selected from during the formation of silver halide grains, during physical ripening, during chemical ripening, and after the termination of chemical ripening.

The photographic emulsion according to the invention is spectrally sensitized to have sensitivity to an intended spectral range, by using a dye known in the photographic art as a sensitizing dye. The sensitizing dyes may be used either singly or in a combination of more than two types.

In conjunction with a sensitizing dye, a supersensitizer, that is, a compound capable of enhancing the sensitizing action of a sensitizing dye, though it does not provide spectral sensitization action nor absorb visible light, may be incorporated into a photographic emulsion.

According to the invention, a compound represented by the following Formula [S] is preferably incorporated into the green-sensitive emulsion layer containing not only silver halide grains having not less than 90 mol% of silver chloride content but also a magenta coupler having pKa value not more than 8.80.

Formula [S]

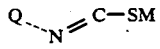

In this formula, Q represents a five- or six-membered heterocyclic ring or an atomic group necessary for completing a five- or six-membered heterocyclic ring condensed with a benzene ring; M represents a hydrogen atom, alkali metal atom, or ammonium.

The examples of the five-membered heterocyclic ring represented by Q in Formula [S] include an imidazole ring, tetrazole ring, thiazole ring, oxazole ring, selenazole ring, benzimidazole ring, naphthoimidazole ring, benzothiazole ring, naphthothiazole ring, benzoselenazole ring, naphthoselenazole ring and benzoxazole ring. The examples of the six-membered heterocyclic ring represented by Q include a pyridine ring, pyrimidine ring, and quinoline ring. Also included are the similar five- and six-membered heterocyclic ring having a substituent.

The examples of alkali metal represented by M include sodium, and potassium atoms.

The particularly preferable compounds, among the compounds represented by Formula [S], are represented by the following Formulas [SA] and [SB].

Formula [SA]

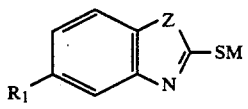

In this formula, $R_A$ represents a hydrogen atom, an alkyl group, alkoxy group, aryl group, halogen atom;

carboxyl group or salt thereof; sulfo group or salt thereof; or amino group. Z represents —NH—, —O—, or —S—. M is synonymous with M in Formula [S].

Formula [SB]

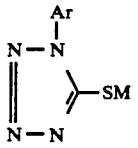

In this formula, Ar represents

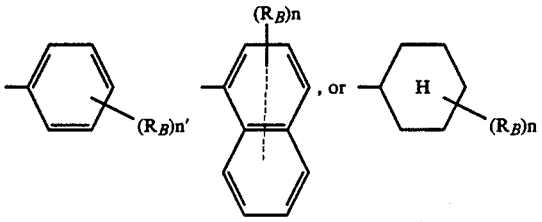

$R_B$ represents an alkyl group, alkoxy group; carboxyl group or salt thereof; sulfo group or salt thereof; hydroxyl group, amino group, acylamino group, carbamoyl group or sulfonamide group. n represents an integer from 0 to 2. M is synonymous with M in Formula [S].

The examples of the alkyl group represented either by $R_A$ or $R_B$ in Formula [SA] or [SB] include a methyl group, ethyl group, and butyl group; the examples of the alkoxy group include a methoxy group and ethoxy group; the examples of the salt of carboxyl or sulfo group include sodium salt and ammonium salt.

The examples of an aryl group represented by $R_A$ in Formula [SA] include a phenyl group and naphthyl group; the examples of the halogen atom include a chloride atom and bromine atom.

The examples of an acrylamino group represented by $R_B$ in Formula [SB] include a methylcarbonylamino group and benxoylamino group; the examples of the carbamoyl group include an ethylcarbamoyl group, and phenylcarbamoyl group; the examples of the sulfonamide group include a methylsulfonamide group, and phenylsulfonamide group.

These alkyl group, alkoxy group, aryl group, amino group, acylamino group, carbamoyl group, and sulfonamide group may have a substituent.

The typical examples of the compounds represented by Formula [S] are as follows.

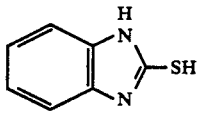

S-1

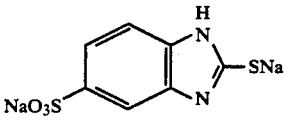

S-2

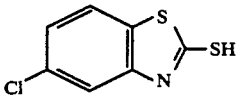

S-3

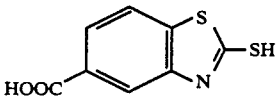

S-4

-continued

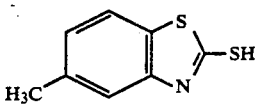

S-5

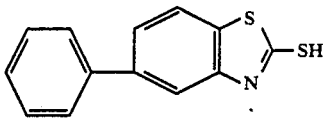

S-6

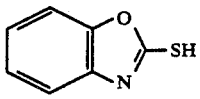

S-7

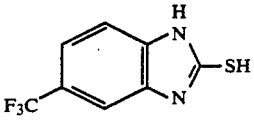

S-8

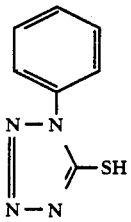

S-9

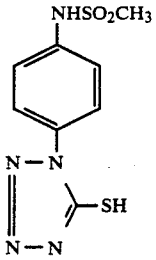

S-10

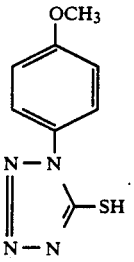

S-11

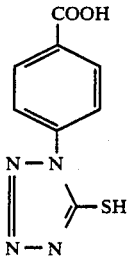

S-12

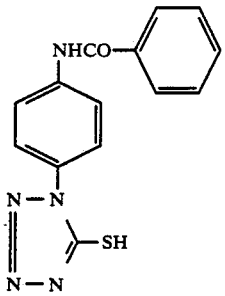

S-13

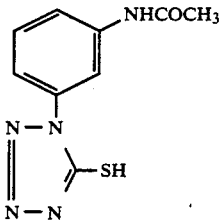

S-14

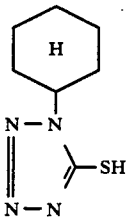

S-15

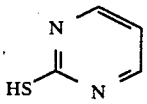

S-16

-continued

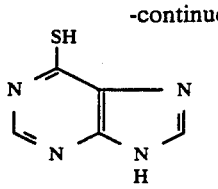

S-17

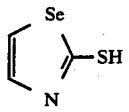

S-18

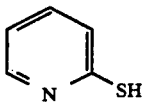

S-19

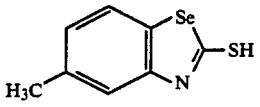

S-20

In order to incorporate the compound represented by Formula [S] (hereinafter referred to as compound [S]) of the invention into the silver halide emulsion layer of the invention, the compound [S] is dissolved in water or any organic solvent, such as methanol or ethanol compatible with water, and the solution is incorporated into the layer. The compound [S] can be used singly or in conjunction with any other compound represented by Formula [S], with stabilizers other than the compound [S], or with antifogging agents.

Timing of adding the compound [S] can be arbitrarily selected among the following periods: before or during the formation of silver halide grains; a period between the termination of silver halide grain formation and before the initiation of chemical ripening during chemical ripening; at the termination of chemical ripening; or a period after the termination of chemical ripening and before coating operation. Preferable timing of the addition is during chemical ripening, at the termination of chemical ripening, or a period after the termination of chemical ripening and before coating operation. Prescribed amount of the compound [S] can be added all at once or in steps.

The compound [S] can be directly added to silver halide emulsion or the coating solution of the silver halide emulsion. Optionally, the compound [S] may be added to the coating solution for a non-light-sensitive hydrophilic colloid layer adjacent to the silver halide emulsion layer, thereby the compound [S] is incorporated into the silver halide emulsion layer of the invention by diffusion from the colloid layer during the multilayer coating operation.

The amount of the compound [S] added to the silver halide emulsion layer is not specifically limited. However, usually, the amount is $1\times10^{-6}$ to $1\times10^{-1}$ mol, or, preferably, $1\times10^{-5}$ to $1\times10^{-2}$ mol per mol silver halide.

Magenta couplers used in the invention have the pKa value of not more than 8.80.

The pKa value according to the invention means a value determined by measuring the pH of a solution at 25° C. using a titration method, wherein the coupler anions (coupler ions whose proton in the active site is released) and the coupler have reached the equibration (both are present in equivalent mol) in the ethanol-water (4:1) mixture solvent. Detailed pKa value measuring methods are described in the Journal of Photographic Science (aforementioned), 13, 248 (1965), and elsewhere.

Any type of couplers can be used if their pKa value is not more than 8.80. However, the preferable couplers are magenta couplers of 5-pyrazolone type.

The typical examples of the magenta couplers of the invention are as follows, although usable couplers are not limited to them.

M-1

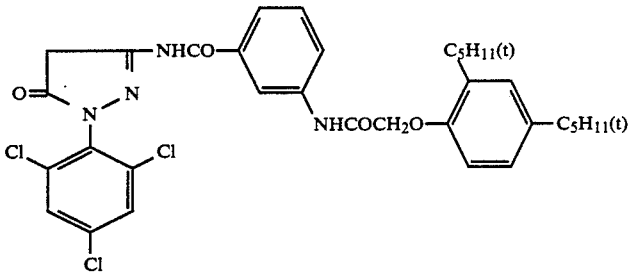

M-2

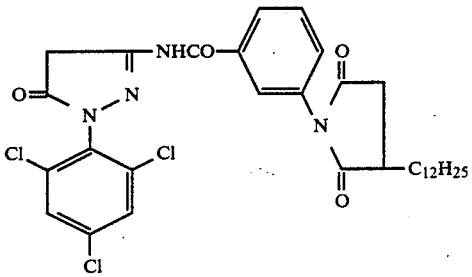

-continued
M-3
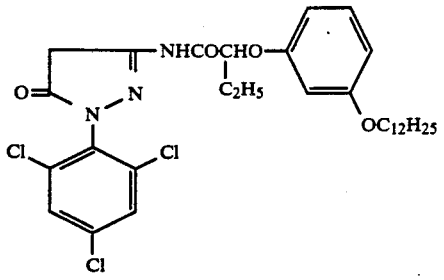
M-4
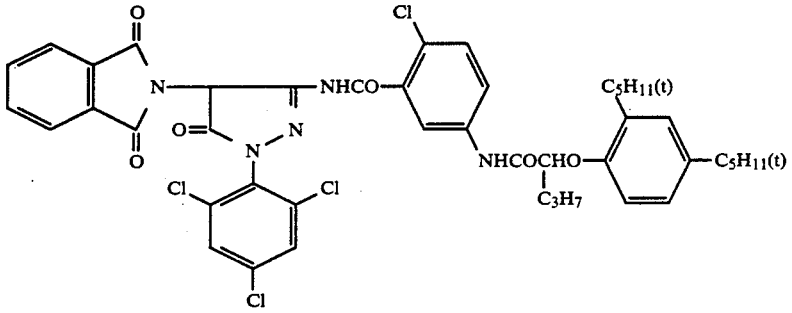
M-5
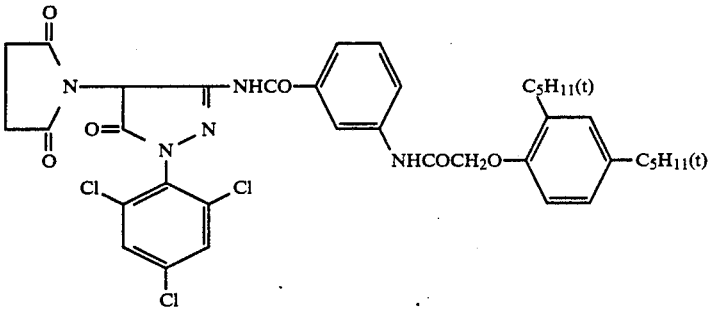
M-6
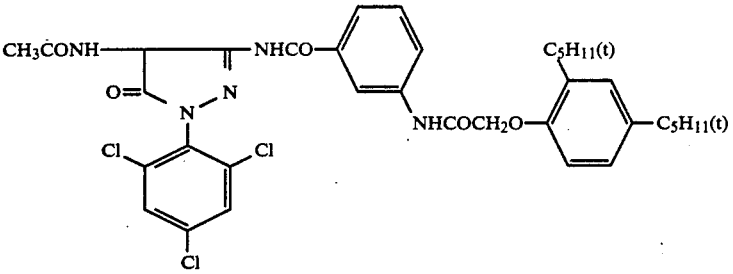
M-7
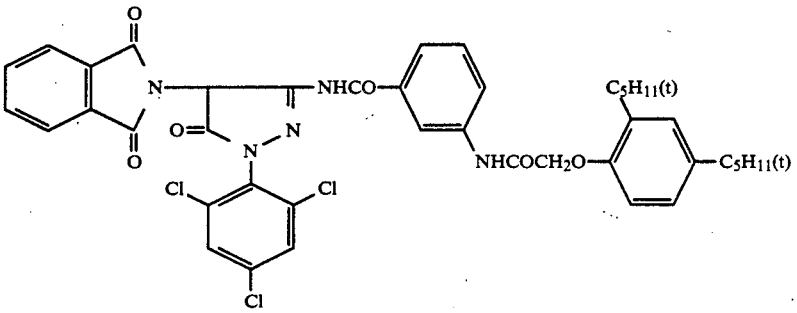

-continued
M-8
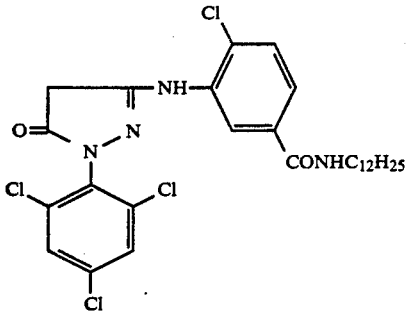
M-9
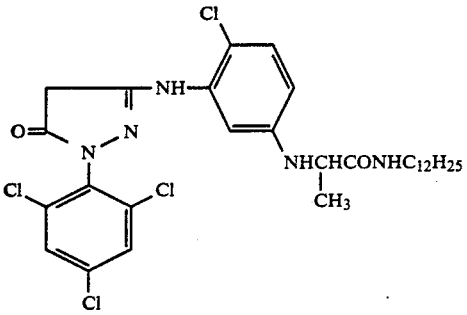
M-10
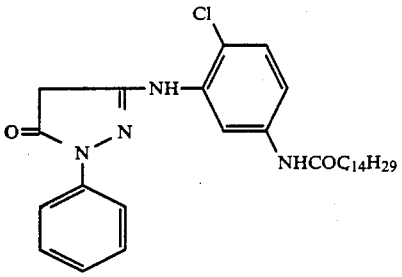
M-11
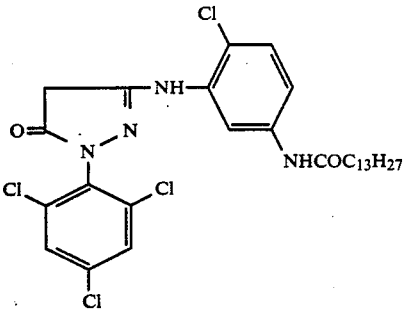
M-12
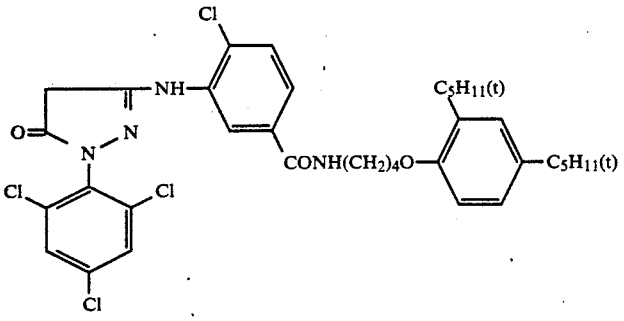

-continued

M-13

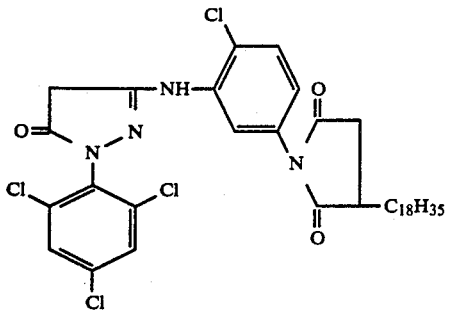

M-14

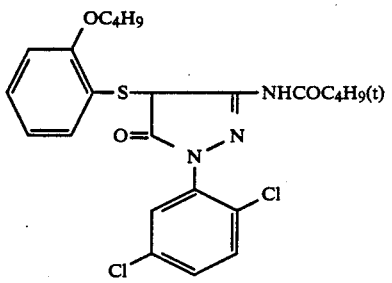

Usually, the magenta coupler of the invention is used in an amount of $1\times10^{-3}$ mol to 1 mol, or, preferably, $1\times10^{-2}$ to $8\times10^{-1}$ mol per mol silver halide.

Every dye forming coupler used in the light-sensitive silver halide photographic material of the invention is desired to have within its molecular structure a group called the ballasts group that comprises not less than 8 carbon atoms and renders the coupler non-diffusible.

As a yellow dye forming coupler, acylacetanilide couplers are advantageously used, and of which benzoylacetanilide and pyvaloylacetanilide compounds are particularly advantageous. Preferable compounds are represented by the following Formula [Y].

Formula [Y]

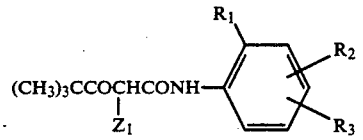

In this formula, $R_1$ represents a halogen atom, or alkoxy group; $R_2$, a hydrogen atom, halogen atom, or alkoxy group; $R_3$, an acylamino group, alkoxycarbonyl group, alkylsulfamoyl group, arylsulfamoyl group, arylsulfonamide group, alkylureide group, arylureide group, succinimide group, alkoxy group, or aryloxy group; $Z_1$, a group capable of being split off upon a coupling reaction with the oxidation product of a color developing agent.

The typical examples of the useful yellow coupler are those described in British Patent No. 1,077,874, Japanese Patent Examined Publication No. 40757/1970; Japanese Patent O.P.I. Publication Nos. 1031/1972, 26133/1972, 94432/1973, 87650/1975, 3631/1976, 115219/1977, 99433/1976, 133329/1979, and 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4 022,620, 4,029,508, 4,057,432, 4,106,942, 4,133,958, 4,269,936, 4,286,053, 4,304,845, 4,314,023, 4,336,327, 4,356,258, 4,386,155, 4,401,752, and the like.

Phenol-type and naphthol-type cyan couplers are used as a cyan dye image forming coupler. The preferable couplers ar represented by the following Formulas [C-I] and [C-II].

Formula [C-I]

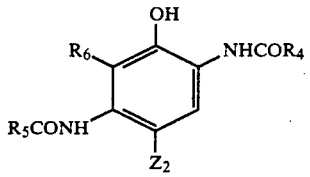

In this formula, $R_4$ represents an aryl group, cycloalkyl group, or heterocyclic group; $R_5$, an alkyl group, or phenyl group, $R_6$, a hydrogen atom, halogen atom, alkyl group, or alkoxy group; $Z_2$, a hydrogen atom, or a group capable of being split off upon a reaction with the oxidation product of an aromatic primary amine color developing agent.

Formula [C-II]

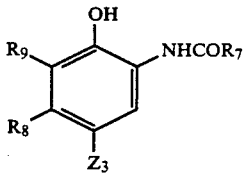

In this formula, $R_7$ represents an alkyl group (such as methyl group, ethyl group, propyl group, butyl group, nonyl group); $R_8$, an alkyl group (such as methyl group, ethyl group); $R_9$, a hydrogen atom, halogen atom (such as fluorine, chlorine, and bromine), or alkyl group (such as methyl group, ethyl group); $Z_3$, a hydrogen atom, or a group capable of being split off upon a reaction with the oxidation product of an aromatic primary amine color developing agent.

These cyan dye image forming couplers are described in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, 3,839,044, British Patent Nos. 478,991, 945,542, 1,084,480, 1,377,233, 1,388,024, 1,543,040, Japanese Patent O.P.I. Publication Nos. 37425/1972, 10135/1975, 25228/1975, 112038/1975, 117422/1975, 130441/1975, 6551/1976, 37647/1976, 52828,1976, 108841/1976, 109630/1978, 48237/1979, 66129/1979, 131931/1979, 32071/1980, 146050/1984, 31953/1984, 117249/1985.

The quantity of the dye image forming coupler used in the invention is usually in a range of $1\times10^{-3}$ to 1 mol, or, preferably, $1\times10^{-2}$ to $8\times10^{-1}$ mol per mol silver halide in each silver halide emulsion layer.

The above dye image forming couplers are usually dissolved in a high boiling organic solvent having a boiling point of not less than 150° C., and, if necessary, in conjunction with other low boiling and/or water soluble organic solvents, and then, the solution is emulsified and dispersed in a hydrophilic binder such as an aqueous gelatin solution by using surface-active agents. Then, the resultant emulsion is added to the intended hydrophilic colloidal layer. A process for removing the low boiling organic solvent after or during dispersion may be incorporated.

Preferable high boiling organic solvents used in the invention are compounds having a dielectric constant not more than 6.0. The examples are esters such as phthalic acid esters and phosphoric acid esters; organic acid amides; ketones; and hydrocarbons; each having a dielectric constant not more than 6.0. Particularly preferable high boiling organic solvents are those that have a dielectric constant of a range not more than 6.0 and not less than 1.9, and that have a vapor pressure not more than 0.5 mmHg at 100° C. Those particularly advantageous are phthalic acid esters and phosphoric acid esters. These solvents may be used as a mixture of two or more than two types.

The dielectric constant according to the invention is a value measured at 30° C.

The phthalic acid esters useful in embodying the invention are represented by the following Formula (A).

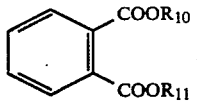

Formula [A]

In this formula, $R_{10}$ and $R_{11}$ independently represent an alkyl group, alkenyl group, or aryl group, provided that the total number of carbon atoms of the groups represented by $R_{10}$ and $R_{11}$ is 8 to 32, preferably, 16 to 24.

The alkyl groups represented by $R_{10}$ and $R_{11}$ of the above Formula [A] can be either straight-chained or branched groups, and the examples of which include a butyl group, pentyl, hexyl, 2-ethylhexyl, 3,5,5-trimethylhexyl, octyl, decyl, dodecyl, tetradecyl, hexadecyl, and octadecyl; the aryl groups represented by $R_{10}$ and $R_{11}$ include a phenyl group, and naphthyl group; the alkenyl groups represented by $R_{10}$ and $R_{11}$ include a hexenyl, heptenyl, and octadecenyl. These alkyl groups, alkenyl groups, and aryl groups include those having a single or plural substituents. The substituents of the alkyl groups and the alkenyl groups include a halogen atom, alkoxy group, aryl group, aryloxy group, alkenyl group, and alkoxycarbonyl group; the substituents of the aryl groups include a halogen atom, alkyl group, alkoxy group, aryl group, aryloxy group, alkenyl group, and alkoxycarbonyl group.

The preferable group of the above $R_{10}$ and $R_{11}$ is alkyl group, such as 2-ethylhexyl group, 3,5,5-trimethylhexyl, octyl, and nonyl.

The phosphoric acid esters preferable in the invention include those represented by the following Formula (B).

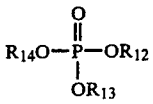

Formula [B]

In this formula, $R_{12}$, $R_{13}$, and $R_{14}$ independently represent an alkyl group, alkenyl group, or aryl group, provided that the total number of the carbon atoms of the groups represented by $R_{12}$, $R_{13}$, and $R_{14}$ is 24 to 54.

The alkyl groups represented by $R_{12}$, $R_{13}$, and $R_{14}$ of Formula [B], include a butyl group, pentyl, hexyl, 2-ethylhexyl, heptyl, nonyl, decyl, dodecyl, tetradecyl, hexadecyl, octadecyl, and nonadecyl; the aryl groups similarly represented include a phenyl group, and naphthyl group; the alkenyl groups similarly represented include a hexenyl group, heptenyl, and octadecenyl.

These alkyl groups, alkenyl groups, and aryl groups include those having a single or plural substituents. The preferable $R_{12}$, $R_{13}$, and $R_{14}$ are alkyl groups such as a 2-ethylhexyl group, octyl, 3,5,5-trimethylhexyl, nonyl, decyl, sec-decyl, sec-dodecyl, and t-octyl.

The typical examples of high boiling organic solvents used in the invention are as follows. However, the scope of useful solvents is not limited only to these examples.

Example High Boiling Organic Solvents

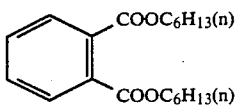

HS-1

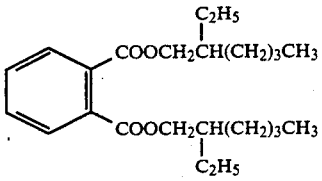

HS-2

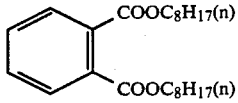

HS-3

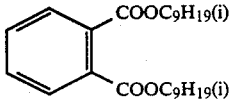

HS-4

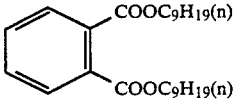

HS-5

-continued

HS-6

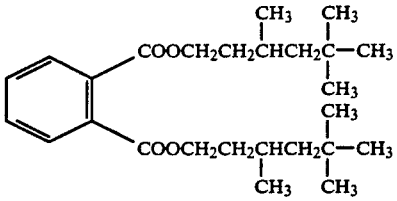

HS-7

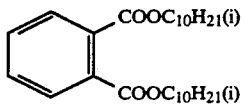

HS-8

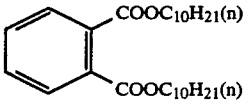

HS-9

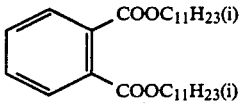

HS-10

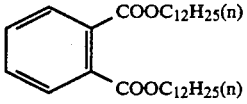

HS-11

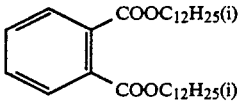

HS-12

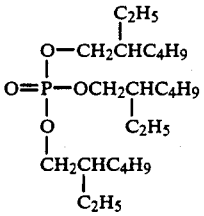

HS-13

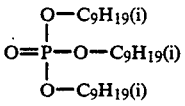

HS-14

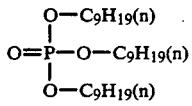

HS-15

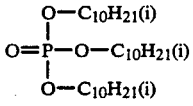

HS-16

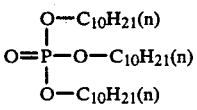

HS-17

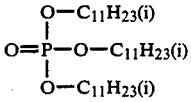

-continued

HS-18

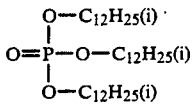

HS-19

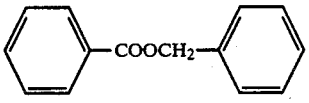

HS-20

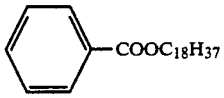

HS-21

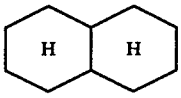

HS-22

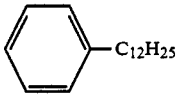

The amount of these high boiling organic solvents added is usually 0 to 400 wt. %, preferably, 10 to 100 wt. % per amount coupler.

The light-sensitive silver halide photographic material of the invention can be a color negative or positive film of the color negative-positive system, or color photographic paper, and the effect of the method according to the invention is positively achieved with a color photographic paper that is visually appreciated.

The light-sensitive silver halide photographic materials of the invention including the color photographic paper can be monochromatic or multicolor materials. For multi-color reproduction by the subtractive color process, the light-sensitive silver halide photographic material usually comprises each silver halide emulsion layers having magenta, yellow, or cyan couplers and non-light-sensitive layers on a support in a laminated structure. The structure has an appropriate number and sequence of the above layers. However, the number and the sequence can be changed according to the main performance being achieved or the purpose being used.

In the case of a multicolor photographic light-sensitive material among the light-sensitive silver halide photographic materials used in the invention, an especially preferable layer constitution formed on a support is in the order of a yellow dye image forming layer, an intermediate layer, a magenta dye image forming layer, an intermediate layer, a cyan dye image forming layer, an intermediate layer, and a protective layer.

The advantageous binder (or a protective colloid) used in the light-sensitive silver halide photographic materials of the invention is gelatin. However, other protective colloids, such as gelatin derivatives, graft polymers of gelatin with other polymer or polymers, proteins, sugar derivatives, cellulose derivatives, synthetic hydrophilic macromolecule materials being monopolymers or copolymers are useful.

The photographic emulsion layers, and the other hydrophilic colloid layers, of the light-sensitive silver halide photographic materials of the invention can be hardened by using one or two or more types of hardeners that cross-link the binder (or the protective colloid)

molecules to enhance layer strength. Hardeners are added to the layers to a degree that is sufficient to harden the layers and eliminate the hardeners added to the processing solution. However, the hardeners may be added to the processing solution.

The preferable hardeners for hardening the silver halide emulsion layer of the invention are those of chlorotriazine series represented by the following Formula [HDA] or [HDB].

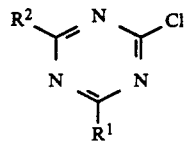

Formula [HDA]

In the formula, $R^1$ represents a chlorine atom, hydroxy group, alkyl group, alkoxy group, alkylthio group, —OM group (M represents a univalent metal atom.), —$NR^3R^4$ group ($R^3$ and $R^4$ independently represent a hydrogen atom, alkyl group, and aryl group), or an —$NHCOR^5$ group (in which $R^5$ is a hydrogen atom, analkyl group or an aryl group). $R^2$ is synonymous with the above $R^1$, except in that a chlorine atom is precluded.

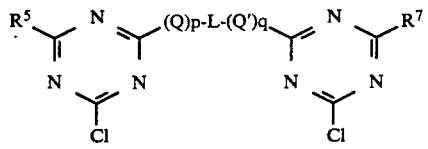

Formula [HDB]

In this formula, $R^6$ and $R^7$ independently represent a chlorine atom, hydroxyl group, alkyl group, alkoxy group, or —OM group (M represents a univalent metal atom). Q and Q' independently represent —O—, —S—, or —NH—, as a bonding group; L, alkylene group, or arylene group; and p and q, independently, 0 or 1.

The typical examples of the preferable hardeners represented by the above Formulas, [HDA] and [HDB], are as follows.

Formula [HDA]

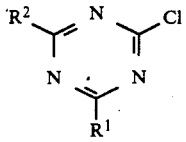

| Compound No. | $R^1$ | $R^2$ |
|---|---|---|
| HD-1 | —OH | —ONa |
| HD-2 | —Cl | —ONa |
| HD-3 | —$OCH_3$ | —ONa |
| HD-4 | —Cl | —$OC_2H_5$ |
| HD-5 | —Cl | —OK |
| HD-6 | —OH | —OK |
| HD-7 | —Cl | —$NH_2$ |
| HD-8 | —Cl | —$NHCOCH_3$ |
| HD-9 | —OH | —$NHC_2H_5$ |

Formula [HDB]

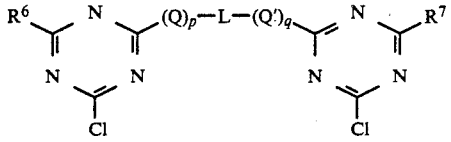

| Compound No. | $R^6$ | $R^7$ | Q | p | Q' | q | L |
|---|---|---|---|---|---|---|---|
| HD-10 | —Cl | —Cl | —O— | 1 | —O— | 1 | 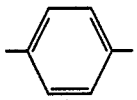 |
| HD-11 | —ONa | —ONa | —O— | 1 | —O— | 1 | —$CH_2CH_2$— |
| HD-12 | —ONa | —ONa | — | 0 | — | 0 | —$CH_2CH_2$— |
| HD-13 | —$OCH_3$ | —$OCH_3$ | —S— | 1 | —S— | 1 | —$CH_2CH_2$— |
| HD-14 | —ONa | —ONa | —NH— | 1 | —NH— | 1 | —$CH_2CH_2$— |
| HD-15 | —ONa | —ONa | —NH— | 1 | —O— | 1 | —$CH_2CH_2$— |

The hardeners represented by Formula [HDA] or [HDB] are first dissolved in water or water miscible solvents (such as methanol or ethanol). Then the resultant solution is added to coating solutions which make the silver halide emulsion layers or other structural layers. The addition method can be either by the batch or in-line system. The timing of the addition is not particularly limited; but, preferably, just before coating.

The amount of these hardeners added is 0.5 to 100 mg, preferably, 2.0 to 50 mg per gram gelatin.

To increase the flexibility of the silver halide emulsion layers and/or other hydrophilic colloid layers, plasticizers can be added to the light-sensitive silver halide photographic materials used in the invention (hereinafter referred to as the light-sensitive silver halide photographic materials of the invention).

To improve the dimension stability and the like of the photographic emulsion layers and other hydrophilic colloid layers, a dispersion (latex) of water insoluble or slightly soluble synthetic polymers can be added to the layers in the light-sensitive silver halide photographic materials of the invention.

To prevent deteriorated dye images, the light-sensitive silver halide photographic materials of the invention can incorporate image stabilizers.

Ultraviolet absorbents can be added to the hydrophilic colloid layers, such as a protective layer, and an intermediate layer, of the light-sensitive silver halide photographic materials of the invention in order to prevent fogging caused by discharging of triboelectricity or the like, and prevent image deterioration caused by ultraviolet ray.

Auxiliary layers, such as a filter layer, an antihalation layer, and/or an anti-irradiation layer, can be incorporated into the light-sensitive silver halide photographic materials of the invention. These layers and/or the emulsion layers may contain a dye that is capable of being eluted from the color light-sensitive materials during the developing process, or that is capable of being bleached during the bleaching process.

Matting agents can be incorporated into the silver halide emulsion layers, and/or other hydrophilic colloid layers of the light-sensitive silver halide photographic materials of the invention in order to decrease gloss, increase retouchability, and prevent mutual adhesion of the light-sensitive materials.

To decrease sliding friction, lubricants can be added to the light-sensitive silver halide photographic materials of the invention.

To prevent electrification, anti-static agents can be added to the light-sensitive silver halide photographic materials of the invention. These anti-static agents can be added to an anti-static layer formed on a side of the support opposite to the emulsion laminated side, or to the emulsion layers and/or protective layers other than the emulsion layers.

Various surface active agents can be used in the photographic emulsion layers and/or other hydrophilic colloid layers of the light-sensitive silver halide photographic materials of the invention in order to meet photographic requirements such as improved coating property, prevention of electrification, improved sliding property, emulsification and dispersion, prevention of adhesion, improved photographic properties (such as developing acceleration, high gradation, and higher sensitivity).

The photographic emulsion layers and the other layers of the light-sensitive silver halide photographic materials of the invention can be formed, by coating, on baryta paper, papers laminated with $\alpha$-olefin polymers and the like; flexible, reflective supports such as synthetic papers; films made of semisynthetic or synthetic polymers such as cellulose acetate, cellulose nitrate, polystyrene, polyvinylchloride, polyethylene terephthalate, polycarbonate, polyamide; or solid materials such as glass, metal, ceramics.

If necessary, corona discharge, ultraviolet irradiation, flame treatment, and the like can be conducted on the surface of the support used as a constituent of the light-sensitive material of the invention. After such treatment, the layers of the light-sensitive material of the invention can be formed directly on the surface of the support, or indirectly on one or two subbing layers that are intended for improving properties such as adhesion-readiness, electrification prevention, dimension stability, wear-resistance, hardness, halation prevention, and improved friction resistance of the support.

In the coating operation of the silver halide emulsion of the photographic light-sensitive materials of the invention, thickeners may be used to improve coating property. Particularly advantageous coating methods are extrusion coating and curtain coating each of which can form plural coating layers at one process.

Color developing agents used in the color developers of the invention include conventionally known agents used over a wide range of various color photographic processes. These developing agents include aminophenol derivatives and p-phenylenediamine derivatives. These compounds are generally used in their salt forms, such as hydrochlorides or sulfates, which are stabler than in their free states. The amount of these compounds used is about 0.1 g to 30 g, preferably, about 1 g to 15 g, per liter color developer solution.

The examples of aminophenol series developers include o-aminophenol, p-aminophenol, 5-amino-2-hydroxytoluene, 2-amino-3-hydroxytoluene, and 2-hydroxy-3-amino-1,4-dimethylbenzene.

The particularly useful aromatic primary amine color developing agents are N,N-dialkyl-p-phenylenediamine compounds whose alkyl and phenyl groups may independently have an arbitrary substituent group. The examples of particularly useful typical compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline hydrochloride, N-ethyl-N-$\beta$-hydroxylethylaminoaniline, 4-amino-3-methyl-N,N-diethylaniline, 4-amino-N-(2-methoxyethyl)-N-ethyl-3-methylaniline-p-tolunesulfonate.

In addition to the above aromatic primary amine color developing agents, an arbitrary conventionally known developer constituent compounds can be added to the color developing solution used for processing the silver halide photographic light-sensitive materials of the invention, and the examples of which include alkali agents, such as sodium hydroxide, sodium carbonate, potassium carbonate; alkali metal thiocyanate, benzyl alcohol, water softeners, and thickeners.

The pH value of the color developer is usually not less than 7, preferably, about 10 to 13.

The temperature for performing the color developing is usually not lower than 15° C., preferably, in a range of 20° to 50° C. The recommendable temperature for rapid developing is not lower than 30° C. Color developing time is usually in a range of 20 to 60 sec., preferably, 30 to 50 sec.

The light-sensitive silver halide photographic materials of the invention contain the above color developing agents as their complete form or as their precursor form in the hydrophilic colloid layers, and can be processed in an activating bath. A color developing agent precursor is a compound being capable of forming a complete color developing agent under an alkaline condition, and the examples of which include Schiff base type precursors of aromatic aldehyde derivatives; multivalent metal ion complex precursors; imide phthalate derivative precursors; amide phosphate amide derivative precursors; sugar amine reactant precursors; and urethane type precursors. Examples of these aromatic primary amine color developing agent precursors are described in U.S. Pat. Nos. 3,342,599, 2,507,114, 2,695,234, 3,179,492, British Patent No. 803,786, Japanese Patent O.P.I. Publication Nos. 185628/1978, 79035/1979, Research Disclosure Nos. 15159, 12146, and 13924.

These aromatic primary amine color developing agents or their precursor is required to be added in an amount sufficient for ensuring positive coloration when subjected to an activating process. The amount, depending on the type of the light-sensitive material, is in a range of 0.1 to 5 mol, preferably, 0.5 to 3 mol per mol silver halide. These color developing agents or their precursors can be used singly or in combination. These developing agents or precursors are incorporated into the light-sensitive materials by one of the following three methods: addition by dissolving them in appropriate solvents such as water, methanol, ethanol, and acetone; addition by emulsifying/dispersing them in high boiling organic solvents such as dibutyl phthalate, dioctyl phthalate, tricresyl phthalate; addition by having them being impregnated in latex polymers as described in Research Disclosure No. 14850.

According to the invention, after color developing, the light-sensitive materials are immediately processed with a processing solution having bleaching power. This solution may also have fixing power (called a bleach-fixer).

In the bleaching process, organic acid metal complexes are used as a bleaching agent. The metal complexes oxidize the metal silver produced by the developing process, restore it to the former silver halide, and, at the same time, allow the non-colored portions of the dye to exhibit coloration. The metal complex is a compound in which an organic acid such as aminopolycarboxylic acid, oxalic acid, or citric acid is attached to a metal ion such as iron, cobalt, or copper iron by means of a coordinate covalent bond. The preferable organic acids for forming their metal complexes are polycarboxylic acids or aminopolycarboxylic acids. The polycarboxylic acids or aminopolycarboxylic acids may be used in the form of their alkali metal salt, ammonium salt or water soluble amine salt.

The typical examples are as follows:

[1] ethylenediaminetetraacetic acid
[2] nitrilotriacetic acid
[3] iminodiacetic acid
[4] disodium ethylenediaminetetraacetate
[5] tetra(trimethylammonium) ethylenediaminetetraacetate
[6] tetrasodium ethylenediaminetetraacetate
[7] sodium nitrilotriacetate The bleaching solution can contain various additives in addition to the above bleaching agents, organic acid metal complexes. The desirable additives are alkali halides or ammonium halides, as a re-halogenizing agent, such as potassium bromide, sodium bromide, sodium chloride, and ammonium bromide; metal salts, or chelating agents.

Further, conventionally known additives which are used in the bleaching solution can be optionally added, and the examples of which include pH buffer agents, such as borate, oxalates, acetates, carbonates, and phosphates; alkylamines, and polyethylene oxides.

In addition, the bleacher and the bleach-fixer may contain one or more pH buffer agents consisting of salts such as sulfites, for example, ammonium sulfite, potassium sulfite, ammonium bisulfite, potassium bisulfite, sodium sulfite, ammonium metabisulfite, potassium disulfite, and sodium metabisulfite; boric acid, borax, sodium hydroxide, potassium hydroxide, sodium carbonate, potassium carbonate, sodium bisulfite, sodium hydrogencarbonate, potassium hydrogencarbonate, acetic acid, sodium acetate, ammonium hydroxide.

When performing the processing of the invention while adding the bleach-fixer replenisher to the bleach-fixer solution (bath), the bleach-fixer solution (bath) may contain thiosulfate, thiocyanate, or sulfite; otherwise, the bleach-fixer replenisher may contain these salts in order to add them to the processing bath.

According to the invention, to enhance the activity of the bleach-fixer, air or oxygen gas may be bubbled into the bleach-fixer bath and the reservoir tank of the bleach-fixer replenisher according to a requirement; or an appropriate oxidizing agent such as hydrogen peroxide, bromate salt, and persulfate salt.

EXAMPLES

The typical examples of the invention are hereunder described.

EXAMPLE 1

On a polyethylene-coated paper support were formed sequentially, by coating, the layers specified below, to obtain a multicolor light-sensitive material. The amounts of compounds are amount in 100 $cm^2$ support.

Layer 1: Blue-sensitive silver chlorobromide emulsion layer (BL), comprising:

Yellow coupler (Y-1), 8 mg; blue-sensitive silver chlorobromide emulsion (containing 99.5 mol% silver chloride), 3.0 mg as converted into metal silver; high-boiling organic solvent (DNP), 3 mg; gelatin, 16 mg;

Layer 2: Intermediate layer comprising:

Hydroquinone derivative (HQ-1), 0.45 mg; gelatin, 4 mg;

Layer 3: Green-sensitive silver chlorobromide emulsion layer, comprising:

Magenta coupler listed in Table 1, 4 mg; green-sensitive silver chlorobromide emulsion (containing 99.5 mol% silver chloride), in an silver amount specified in Table 1; high-boiling organic solvent (DOP), 4 mg; anti-fading agents (AO-1, AO-2), each 0,5 mol per mol magenta coupler; gelatin, 16 mg;

Layer 4: Intermediate layer, comprising:

Ultraviolet absorbents (UV-1, UV-2), each 3 mg; DNP, 4 mg; HQ-1, 0.45 mg; gelatin, 14 mg;

Layer 5: Red-sensitive silver chlorobromide emulsion layer, comprising:

Cyan couplers (C-1, C-2), each 2 mg; DOP, 4 mg; red-sensitive silver chloride (containing 99.5 mol% silver chloride), 2.0 mg as converted into metal silver; gelatin, 14 mg;

Layer 6: Intermediate layer, comprising:

UV-1, 2 mg; UV-2, 2 mg; DNP, 2 mg; gelatin, 6 mg;

Layer 7:

Gelatin, 9 mg

Y-1
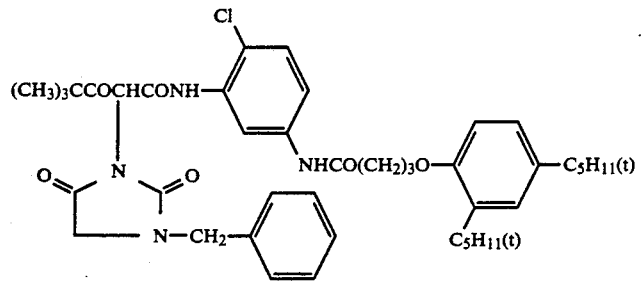
HQ-1
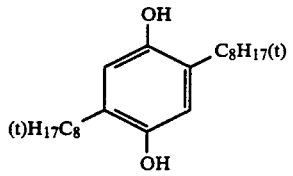
AO-1
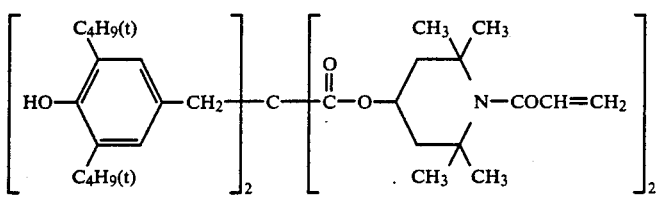
AO-2
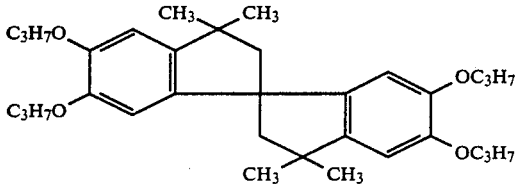
UV-1
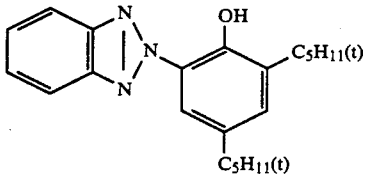
UV-2
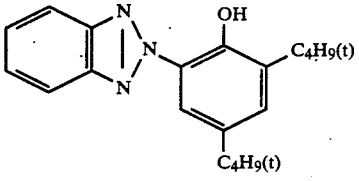
C-1
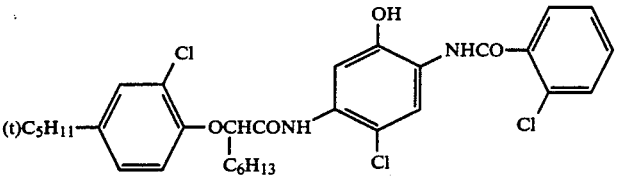
C-2
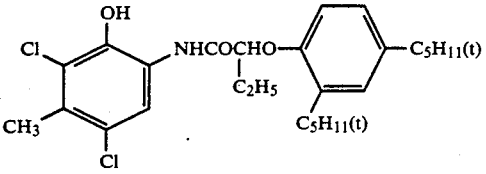
DNP: di-i-nonylphthalate -continued DOP: di-2-ethylhexylphthalate The so-prepared sample was subjected to wedge exposing using green light, based on a conventional method, and then, according to the following processing steps, processed using an automatic developing machine that had under gone running treatment.

| [Processing steps] | Temperature | Time |
|---|---|---|
| Color developing | 34.7 ± 0.3° C. | 45 sec. |
| Bleach-fixing | 34.7 ± 0.5° C. | 45 sec. |
| Stabilizing | 30–34° C. | 90 sec. |
| Drying | 60–80° C. | 60 sec. |

| (Color developer) | |
|---|---|
| Ethylene glycol | 10 ml |
| N,N-diethylhydroxylamine | 10 ml |
| Potassium chloride | 2 g |
| N-ethyl-N- -methanesulfonamidoethyl-3-methyl-4-aminaniline sulfate | 5 g |
| Sodium tetrapolyphosphate | 2 g |
| Potassium carbonate | 30 g |
| Fluorescent whitening agent (4,4'-diaminostylbene disulfonate derivative) | 1 g |

Pure water was added to 1 lit., and the pH was adjusted to 10.08.

| (Bleach-fixer) | |
|---|---|
| Ferric ammonium ethylenediaminetetraacetate | 60 g |
| Ethylenediaminetetraacetic acid | 3 g |
| Ammonium thiosulfate (70% solution) | 100 ml |
| Ammonium sulfite (40% solution) | 27.5 ml |

Water was added to 1 lit., and the pH was adjusted to 7.1 (5.5) using potassium carbonate (glacial acetic acid).

| (Stabilizer) | |
|---|---|
| 5-chloro-2-methyl-4-isothiazoline-3-one | 1 g |
| 1-hydroxyethylidene-1,1-diphosphonate | 2 g |

Water was added to 1 lit., and the pH was adjusted to 8.2 with sulfuric acid or potassium hydroxide.

Each of the so-treated samples was evaluated for the developability, desilverization, and stains, according to the following criteria. The results are summarized in Table 1.

Developability

The maximum reflective density (Dmax) of each sample was measured and used as an index for "developability".

Desilverization

Gelatin on the high coloration portion of the processed wedge piece was dissolved, thereby the amount of residual silver was measured and was used as an index for "desilverization".

Process-induced stains

The green reflective density ($D^G$min) on the white portion of the processed wedge piece was measured, thereby the measurement was used as an index for "process-induced stains (magenta)".

TABLE 1

| | | Green-sensitive silver halide emulsion | | | | | | | |
|---|---|---|---|---|---|---|---|---|---|
| Test No. | Sample No. | AgCl mol % | Coating silver weight*1 | Magenta coupler Type | pKa | Bleach-fixer pH | Developability $D^G$max | Desilverization (mg/dm²) | Stain $D^G$min |
| 1 (Comparative) | 1 | 99.5 | 3.5 (8.5) | Comparative A*2 | 8.95 | 5.5 | 2.78 | 0 | 0.08 |
| 2 (Comparative) | 1 | 99.5 | 3.5 (8.5) | Comparative A*2 | 8.95 | 7.1 | 2.80 | 0.6 | 0.11 |
| 3 (Comparative) | 2 | 99.5 | 3.5 (8.5) | M-1 | 7.25 | 5.5 | 2.88 | 0 | 0.08 |
| 4 (Comparative) | 2 | 99.5 | 3.5 (8.5) | M-1 | 7.25 | 7.1 | 2.90 | 0.5 | 0.09 |
| 5 (Comparative) | 3 | 99.5 | 3.5 (8.5) | M-11 | 8.64 | 5.5 | 2.85 | 0 | 0.08 |
| 6 (Comparative) | 3 | 99.5 | 3.5 (8.5) | M-11 | 8.64 | 7.1 | 2.86 | 0.6 | 0.09 |
| 7 (Comparative) | 4 | 99.5 | 3.5 (8.5) | M-13 | 8.70 | 5.5 | 2.84 | 0 | 0.08 |
| 8 (Comparative) | 4 | 99.5 | 3.5 (8.5) | M-13 | 8.70 | 7.1 | 2.86 | 0.6 | 0.10 |
| 9 (Comparative) | 5 | 99.5 | 2.7 (7.7) | Comparative A | 8.95 | 5.5 | 2.44 | 0 | 0.05 |
| 10 (Comparative) | 5 | 99.5 | 2.7 (7.7) | Comparative A | 8.95 | 7.1 | 2.48 | 0.4 | 0.07 |
| 11 (Invention) | 6 | 99.5 | 2.7 (7.7) | M-1 | 7.25 | 5.5 | 2.54 | 0 | 0.03 |
| 12 (Comparative) | 6 | 99.5 | 2.7 (7.7) | M-1 | 7.25 | 7.1 | 2.56 | 0.4 | 0.04 |
| 13 (Invention) | 7 | 99.5 | 2.7 (7.7) | M-11 | 8.64 | 5.5 | 2.52 | 0 | 0.03 |
| 14 (Comparative) | 7 | 99.5 | 2.7 (7.7) | M-11 | 8.64 | 7.1 | 2.57 | 0.5 | 0.04 |
| 15 (Invention) | 8 | 99.5 | 2.7 (7.7) | M-13 | 8.70 | 5.5 | 2.51 | 0 | 0.03 |
| 16 (Comparative) | 8 | 99.5 | 2.7 (7.7) | M-13 | 8.70 | 7.1 | 2.56 | 0.4 | 0.05 |
| 17 (Comparative) | 9 | 80 | 2.7 (7.7) | M-13 | 8.70 | 5.5 | 1.52 | 0.2 | 0.03 |
| 18 (Comparative) | 9 | 80 | 2.7 (7.7) | M-13 | 8.70 | 7.1 | 1.64 | 0.7 | 0.04 |
| 19 (Comparative) | 10 | 20 | 2.7 (7.7) | M-13 | 8.70 | 5.5 | 0.81 | 0.5 | 0.03 |
| 20 (Comparative) | 10 | 20 | 2.7 (7.7) | M-13 | 8.70 | 7.1 | 0.98 | 0.9 | 0.04 |
| 21 (Invention) | 8 | 99.5 | 2.7 (7.7) | M-13 | 8.70 | 6.5 | 2.51 | 0 | 0.03 |
| 22 (Invention) | 8 | 99.5 | 2.7 (7.7) | M-13 | 8.70 | 6.8 | 2.52 | 0.3 | 0.04 |

TABLE 1-continued

| Test No. | Sample No. | Green-sensitive silver halide emulsion AgCl mol % | Green-sensitive silver halide emulsion Coating silver weight*1 | Magenta coupler Type | Magenta coupler pKa | Bleach-fixer pH | Developability $D^G max$ | Desilverization (mg/dm²) | Stain $D^G min$ |
|---|---|---|---|---|---|---|---|---|---|
| 23 (Comparative) | 8 | 99.5 | 3.0 (8.0) | M-13 | 8.70 | 5.5 | 2.51 | 0.3 | 0.04 |

*1Indicated in mg/dm²; data in ( ) indicates the total silver amount.
*2Comparative magenta coupler A

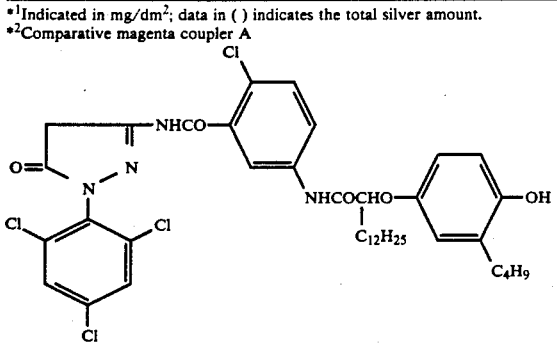

It is understood from the results in Table 1 that the dye image forming method of the invention alone can provide, even by rapid processing, dye images that were free from the deteriorated maximum density, stains owing to poor desilverization, and processing-induced stains (magenta coloration on the non-exposed portions), wherein the dye image forming method of the invention used a sample of the invention whose total silver weight being not more than 7.8 mg/dm² (not more than 2.8 mg/dm² for the green-sensitive silver halide) and whose silver chloride being not less than 90%, and whose pKa of the magenta coupler being not more than 8.80, and wherein the pH of the bleach-fixer was not more than 6.5. However, these facts have not been expected.

Furthermore, the dye images according to the method of the invention were vivid ones free from the magenta coloration on the non-exposed portions (white portions), and stains (caused by poor desilverization) on the magenta coloration portions.

EXAMPLE 2

On a polyethylene-coated paper support (containing anatase titanium oxide, 50 mg/dm²) were formed sequentially, by coating, the layers specified below, to obtain a multicolor light-sensitive material.

Layer 1: Blue-sensitive silver chlorobromide emulsion layer (BL), comprising:

Yellow coupler (Y-2), 8 mg/dm²; blue-sensitive silver chlorobromide emulsion (containing 99.5 mol% silver chloride, mixture of emulsions of different grain sizes), 3 mg/dm² as converted into metal silver; high boiling organic solvent (DBP), 3 mg/dm²; gelatin, 16 mg/dm²;

Layer 2: Intermediate layer comprising:

Hydroquinone derivative (HQ-3), 0.80 mg/dm²; gelatin, 4 mg/dm²

Layer 3: Green-sensitive silver chlorobromide emulsion layer, comprising:

Magenta coupler listed in Table 2, 4 mg/dm²; green-sensitive silver chlorobromide emulsion; high boiling organic solvent (TOP), 4 mg/dm²; anti-fading agent (AO-2), 4 mg/dm² (including magenta anti-irradiation dye); gelatin, 16 mg/dm²;

Layer 4: Intermediate layer, comprising:

Ultraviolet absorbents (UV-1), 3 mg/dm², and (UV-2), 3 mg/dm²; high boiling organic solvent TNP, 4 mg/dm²; hydroquinone derivative (HQ-1), 0.45 mg/dm²; gelatin, 14 mg/dm²;

Layer 5: Red-sensitive silver chlorobromide emulsion layer, comprising:

Cyan coupler (C-3), 2 mg/dm², and (C-4) 2 mg/dm²; high boiling organic solvent (TCP), 4 mg/dm²; ultraviolet absorbent (UV-4), 2 mg/dm²; red-sensitive silver bromide emulsion (containing 99.7 mol% silver chloride) (including cyan anti-irradiation dye), 2.0 mg/dm² as converted into metal silver; gelatin, 14 mg/dm²;

Layer 6: Intermediate layer, comprising:

Ultraviolet absorbent (UV-3), 4 mg/dm²; TNP, 2 2 mg/dm²; gelatin, 6 mg/dm²;

Layer 7: Protective layer comprising:

Gelatin, 9 mg/dm²; chlorotriazine hardener.

(Compounds used for sample preparation)

Y-2

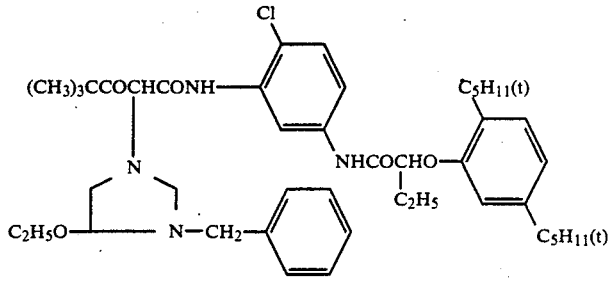

-continued (Compounds used for sample preparation)

HQ-2

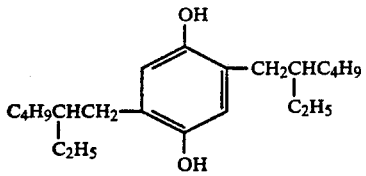

HQ-3

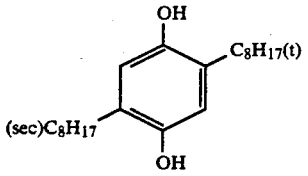

UV-3

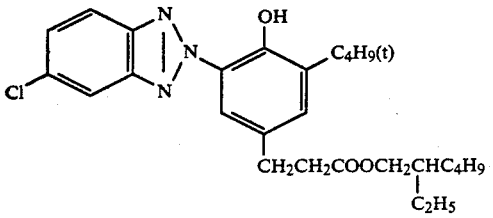

UV-4

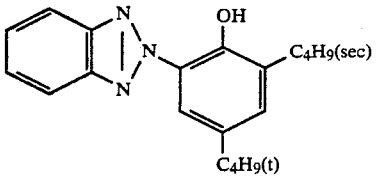

C-3

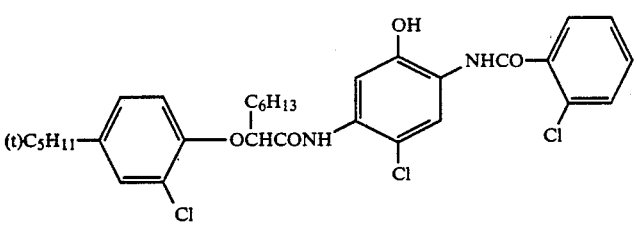

C-4

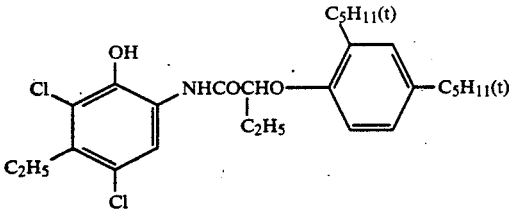

DBP: dibutylphthalate
TOP: trioctylphosphate
TNP: trinonylphosphate
TCP: tricresylphosphate Next, samples identical to those in Example 1 were prepared, except that the magenta coupler and silver halide emulsion of Layer 3 were modified as specified in Table 2, thereby these samples were subjected to exposing same as that of Example 1, and the pH of the bleach-fixer used was 5.5.

The developability, desilverization, and processing-induced stains of each of the so-obtained samples were evaluated in a manner identical to that of Example 1.

The evaluation results are summarized in Table 2.

TABLE 2

| | Green-sensitive silver halide emulsion | | | Magenta coupler | | Developability | Desilverization | Stain |
|---|---|---|---|---|---|---|---|---|
| Test No. | AgCl mol % | Coating silver weight*1 | Compound S*3 | Type | pKa | $D^G max$ | (mg/dm$^2$) | $D^G min$ |
| 24 (Comparative) | 99.8 | 3.5 (8.5)*1 | S-14 | Comparative A*2 | 8.95 | 2.74 | 0 | 0.09 |

TABLE 2-continued

| Test No. | Green-sensitive silver halide emulsion AgCl mol % | Coating silver weight*1 | Compound S*3 | Magenta coupler Type | pKa | Developability $D^G$max | Desilverization (mg/dm²) | Stain $D^G$min |
|---|---|---|---|---|---|---|---|---|
| 25 (Comparative) | 99.8 | 3.5 (8.5)*1 | S-14 | M-1 | 7.25 | 2.79 | 0 | 0.09 |
| 26 (Comparative) | 99.8 | 3.5 (8.5)*1 | S-14 | M-11 | 8.64 | 2.77 | 0 | 0.08 |
| 27 (Comparative) | 99.8 | 3.5 (8.5)*1 | S-14 | M-13 | 8.70 | 2.78 | 0 | 0.09 |
| 28 (Comparative) | 99.8 | 2.7 (7.7) | S-14 | Comparative A | 8.95 | 2.42 | 0 | 0.06 |
| 29 (Invention) | 99.8 | 2.7 (7.7) | S-14 | M-1 | 7.25 | 2.51 | 0 | 0.03 |
| 30 (Invention) | 99.8 | 2.7 (7.7) | S-14 | M-11 | 8.64 | 2.49 | 0 | 0.03 |
| 31 (Invention) | 99.8 | 2.7 (7.7) | S-14 | M-13 | 8.70 | 2.50 | 0 | 0.03 |
| 32 (Comparative) | 80 | 2.7 (7.7) | S-14 | M-13 | 8.70 | 1.47 | 0 | 0.03 |
| 33 (Comparative) | 20 | 2.7 (7.7) | S-14 | M-13 | 8.70 | 0.77 | 0.2 | 0.03 |
| 34 (Invention) | 99.8 | 2.7 (7.7) | — | M-13 | 8.70 | 2.52 | 0 | 0.03 |
| 35 (Comparative) | 99.8 | 3.0 (8.0) | — | M-13 | 8.70 | 2.53 | 0.2 | 0.03 |

*1Indicated in mg/dm²; data in ( ) indicates the total silver amount.
*2Comparative magenta coupler A same as in Table 1
*3$1.5 \times 10^{-3}$ mol/molAgX added It is understood from the results in Table 2 that the samples of the invention formed vivid dye images that were free from the processing-induced magenta stains, deteriorated desilverization and developability.

EXAMPLE 3

Sample No. 36 identical to the sample in Test No. 11 of Example 1, except that this sample incorporated cyan coupler C-2 alone at 4 mg/dm², as well as Sample No. 37 that incorporated cyan coupler C-1 alone at 4 mg/dm² were prepared and subjected to neutral color developing, thereby Sample No. 36 exhibited a reddish neutral image, while Sample No. 37 provided a superior neutral image.

What is claimed is:

1. A method of forming a dye image comprising the steps of,
   (i) imagewise exposing a light-sensitive silver halide photographic material comprising a support and provided thereon a blue-sensitive silver halide emulsion layer, a green-sensitive silver halide emulsion layer and a red-sensitive silver halide emulsion layer, wherein said green-sensitive silver halide emulsion layer contains silver halide grains of which silver chloride content is not less than 90 mol%, and a 5-pyrazolone-type magenta dye-forming coupler having a pKa value of not more than 8.80; and wherein the total amount of silver halide contained in said blue-sensitive, green-sensitive and red-sensitive layers being not more than 7.8 mg/dm² in terms of silver;
   (ii) color developing said photographic material; and immediately after the color development,
   (iii) processing said photographic material with a solution having a bleaching capability and having a pH value of from 4.5 to 6.5.

2. The method of claim 1, wherein said silver halide grain is a silver chlorobromide containing 0.1 to 2 mol% of silver bromide.

3. The method of claim 1, wherein said green-sensitive silver halide emulsion layer contains said silver halide grains in a proportion of not less than 60% by weight with respect to the total silver halide grains contained therein.

4. The method of claim 1, wherein said green-sensitive silver halide emulsion layer contains said silver halide grains in a proportion of not less than 80% by weight with respect to the total silver halide grains contained therein.

5. The method of claim 1, wherein said magenta dye-forming coupler is contained at a quantity of $1 \times 10^{-3}$ mol to 1 mol per 1 mol of silver halide.

6. The method of claim 5, wherein said quantity is $1 \times 10^{-2}$ mol to $8 \times 10^{-1}$ mols per 1 mol of silver halide.

7. The method of claim 1, wherein said blue-sensitive silver halide emulsion layer contains a yellow dye-forming coupler having the formula [Y];

[Y]

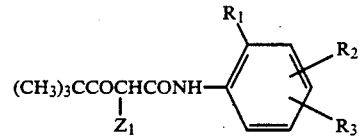

wherein $R_1$ is a halogen atom or an alkoxy group; $R_2$ is selected from a hydrogen atom, a halogen atom and an alkoxy group; $R_3$ is selected from an acylamino group, an alkoxycarbonyl group, an alkylsulfamoyl group, an arylsulfamoyl group, an arylsulfonamido group, an alkylureido group, an arylureido group, a succinicimido group, an alkoxy group, an aryloxy group; and $Z_1$ is an atom or a group which is capable of being split off upon reaction with the oxidation product of a color developing agent.

8. The method of claim 1, wherein said red-sensitive silver halide emulsion layer contains a cyan dye-forming coupler of formula [C-1] or formula [C-11];

[C-I]

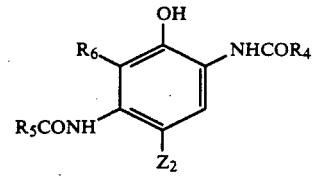

wherein $R_4$ is selected from an aryl group, a cycloalkyl and a heterocyclic group; $R_5$ is an alkyl group or an aryl group; $R_6$ is selected from a hydrogen atom, a halogen atom and an aryl group; $Z_2$ is a hydrogen atom or a group capable of being split off upon reaction with the oxidation product of a color developing agent;

[C-II]

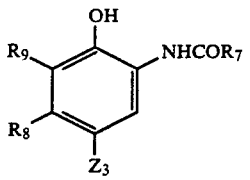

wherein $R_7$ is an alkyl group; $R_8$ is an alkyl group; $R_9$ is selected from a hydrogen atom, a halogen atom and an alkyl group; and $Z_3$ is a hydrogen atom or a group capable of being split off upon reaction with the oxidation product of a color developing agent.

9. The method of claim 1, wherein said greensensitive silver halide emulsion layer contains a compound represented by formula [S];

[S]

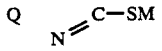

wherein represents a group of atoms necessary to form a 5-member or 6-member heterocyclic ring, and M is a hydrogen atom, an alkali metal atom or an ammonium group.

* * * * *